US005541816A

United States Patent [19]

Miserendino

[11] Patent Number: 5,541,816

[45] Date of Patent: Jul. 30, 1996

[54] CLIP LIGHT SOURCE

[76] Inventor: Nicholas G. Miserendino, 43 Berkeley Pl., Livingston, N.J. 07039

[21] Appl. No.: 485,376

[22] Filed: Jun. 7, 1995

[51] Int. Cl.[6] ..... F21L 15/14

[52] U.S. Cl. ..... 362/106; 362/191; 362/396

[58] Field of Search ..... 362/103, 106, 362/107, 191, 396, 275; 2/209.13

[56] References Cited

U.S. PATENT DOCUMENTS

| | | | |
|---|---|---|---|
| 1,572,210 | 2/1926 | Kolibas | 362/106 |
| 2,524,881 | 10/1950 | Chambers | 362/190 |
| 3,032,647 | 5/1962 | Wansky et al. | 362/106 X |
| 3,133,705 | 5/1964 | Eickelman | 362/106 |
| 4,406,040 | 9/1983 | Cannone | 24/3.12 |
| 4,827,384 | 5/1989 | Von Schlemmer | 362/106 |
| 4,991,068 | 2/1991 | Mickey | 362/106 |
| 5,154,483 | 10/1992 | Zeller | 362/198 |
| 5,463,538 | 10/1995 | Womack | 362/106 |

OTHER PUBLICATIONS

Pelican Products, Inc. 1995 Brochure describing VERSALITE™ Product.

*Primary Examiner*—Stephen F. Husar
*Attorney, Agent, or Firm*—Stroock & Stroock & Lavan

[57] ABSTRACT

A clip light source constructed to be mountable onto a brim of a hat includes a light source housing for housing a light source and a battery housing electrically coupled to the light source housing. The light source housing and the battery housing are mounted to the brim of the hat such that the brim is intermediate the light source housing and the battery housing when mounted thereon. The light source housing can rotate 360° about a plane parallel to the brim of the hat.

19 Claims, 3 Drawing Sheets

FIG. 9
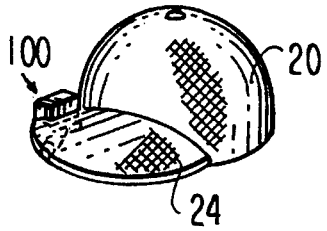
FIG. 10
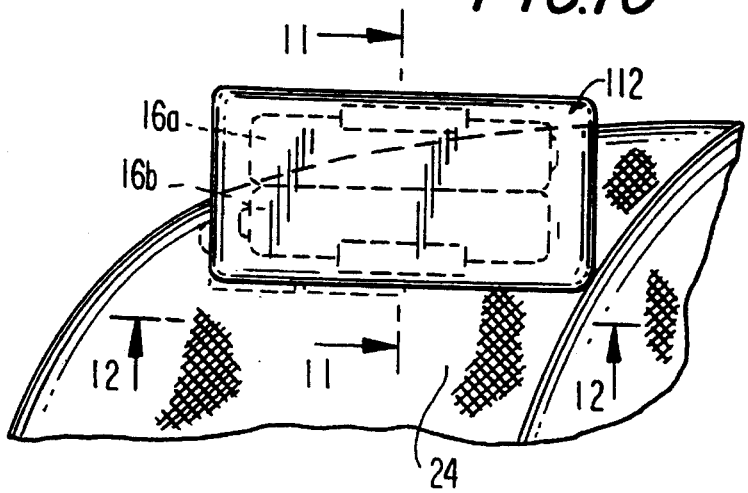
FIG. 11
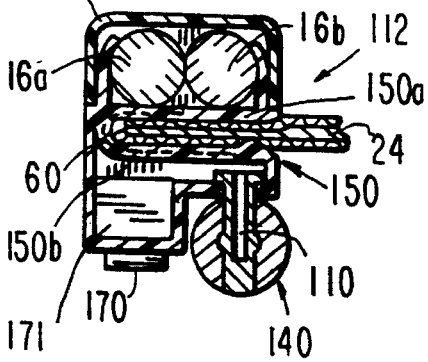
FIG. 12
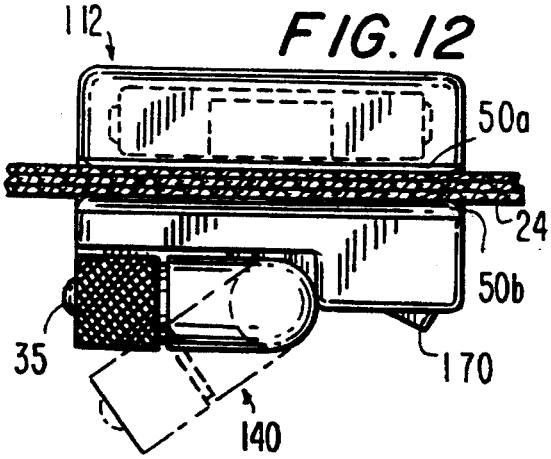
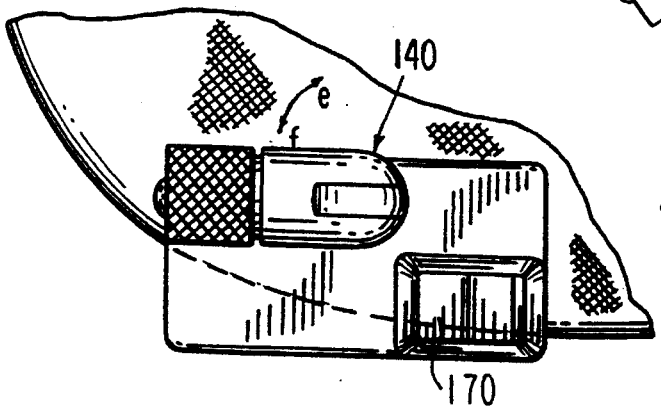
FIG. 13

CLIP LIGHT SOURCE

BACKGROUND OF THE INVENTION

The present invention is directed to illumination devices and, in particular, to an illumination device that can be easily mounted to a hat brim or other clothing by either a clip or mounting pins that enable a user to illuminate the area in which the user is working and at the same time, use both hands to perform the task before him or her.

Various light attachments for hats have been developed over the years for the purpose of providing a user with a way of illuminating the area in which the user desires illumination while permitting the user's hands to perform a required task. This is typically the situation when there is no convenient location on which a flashlight or clip light can be mounted, but precise illumination is still required.

Prior art illumination constructions for hats characteristically fall into two general categories. The first category is the headlamp carriers which require complicated mounting mechanisms and specially constructed hats to permit the mounting of the light source thereon. Examples of this type of hat and light source are found in U.S. Pat. No. 3,133,705, U.S. Pat. No. 4,991,068 and U.S. Pat. No. 4,827,384. The second type of conventional illumination device, used generally with a hat, is a clip-on device which clips to the brim of a hat. An example of this clip-on construction, wherein the power supply and light source is mounted above the brim and the rotation of the light source is limited, is described in U.S. Pat. No. 4,406,040.

However, the devices described in the aforementioned patents have been less than adequate for the following reasons. First, prior art illumination devices for hats have required that both the light source and the batteries are located above the brim, or below a shield as described in U.S. Pat. No. 4,827,384, typically in a single housing. The result is a non-symmetrical distribution of weight about the hat's brim which can result in an uncomfortable and awkward feeling for the user. Secondly, the previously described devices have light sources which are very limited in the range in which they can rotate and be positioned. Typically, the prior art devices cannot rotate 360° (180° in either direction) about a plane parallel to the brim of the hat on which it is mounted and, therefore, are limited in their applications or use. For example, the prior art clip-on devices cannot be mounted to a jacket lapel, shirt pocket or belt since the light beam could not be adjusted to prevent the light from aiming back or up in the direction of the user's face. In addition, a light source that is positioned above the brim of the hat is harder to aim than a light source that is below the brim and which more closely resembles the line of sight of the user. Likewise, by providing the light source above the brim, there is the increased possibility of scattering light waves and shading of the work area by the brim hat which may result in harm to the user as well as limiting the application for the device, such as, reading or working at close range. Lastly, by positioning both the light source and power source on the same side of the brim, an overall bulky look results, making it less likely that a hat wearer, concerned with the appearance of the hat, will wear the light.

Accordingly, an improved light source device that can be used alone or in combination with the brim of a hat, that can be mounted thereon by use of pins or a clip, that more equally distributes its weight above and below the brim of the hat, that provides improved aesthetics, and has the capability to rotate 360° (at least 180° in either direction) about an axis parallel to the brim of a hat is desired.

SUMMARY OF THE INVENTION

Generally speaking, in accordance with the present invention, a clip light source device constructed to be mountable onto a hat having a brim is provided. The clip light source device includes a light source housing for housing a light source, an energy source housing electrically coupled to the light source housing for housing an energy source for supplying energy to the light source, and a clip that is releasable securable to the brim of the hat. The clip includes a first prong and a second prong, the light source housing being secured to the first prong and the energy source housing being secured to the second prong, whereby the brim is intermediate the light source housing and the energy source housing when the clip light source device is mounted on the brim of the hat.

In an alternative embodiment, a light source device similar to the first mentioned clip light source device is provided, but in place of the clip to releasable secure the device to a hat, for example, this alternative embodiment includes mounting pins to releasable connect the energy source housing to the brim of the hat and connector pins for electrically connecting the energy source housing to the light source housing to permit illumination of the light source.

Accordingly, it is an object of the present invention to provide an improved light source device.

Another object of the invention is to provide an improved light source that is more comfortable to wear.

Still another object of the invention is to provide an improved light source that is more versatile in its application and has a construction that provides an improved light beam with a reduction in light diffraction.

Yet another object of the invention is to provide an improved light source device that can be mounted on the brim of a hat, jacket, or other article of clothing or stationary object and still have its light source directed at the desired area.

Still another object of the invention is to provide an improved light source device that is more aesthetically pleasing.

Another object of the invention is to provide an improved light source device that includes a light source that is easier to aim at a desired area.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 9 is a perspective view of a clip light source device in accordance with a third embodiment of the present invention, the clip light source device having been mounted onto a conventional hat with a brim;

FIG. 10 is a top plan view of the clip light source device of FIG. 9;

FIG. 11 is a cross-sectional view of the clip light source device taken along lines 11—11 of FIG. 10;

FIG. 12 is a is a cross-sectional view of the clip light source device taken along lines 12—12 of FIG. 10; and FIG. 13 is a bottom plan view of the clip light source device of FIG. 9.

DETAILED DESCRIPTION OF THE PREFERRED EMBODIMENTS

Figure 1:
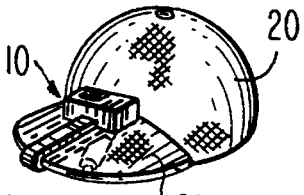
FIG. 1 is a perspective view of a clip light source device in accordance with a first embodiment of the present invention, the clip light source device having been mounted onto a conventional hat with a brim.
Figure 2:
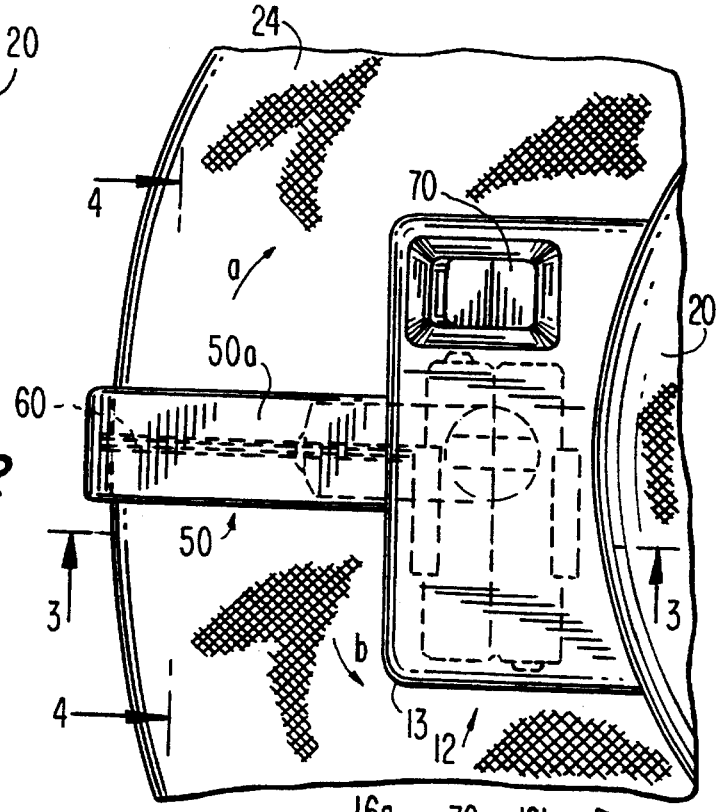
FIG. 2 is a top plan view of the clip light source device of FIG. 1.
Figure 3:
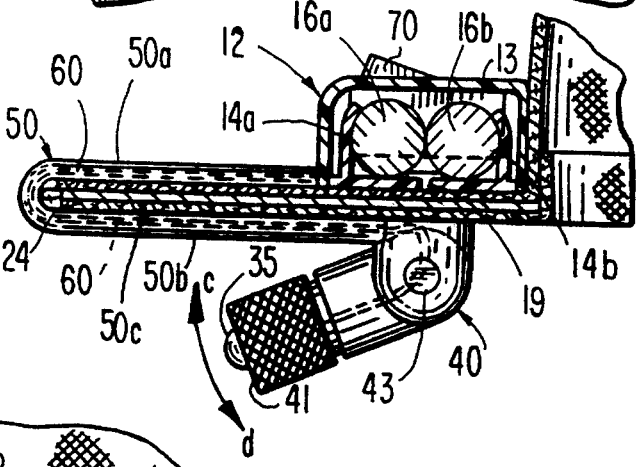
FIG. 3 is a cross-sectional view of the clip light source device taken along lines 3—3 of FIG. 2.
Figure 4:
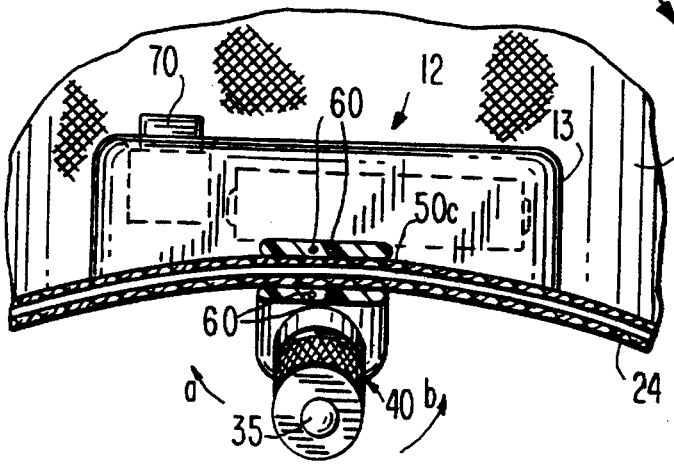
FIG. 4 is a cross—sectional view of the clip light source device taken along lines 4—4 of FIG. 2.
Figure 5:
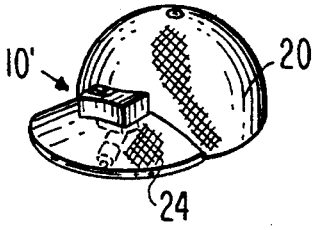
FIG. 5 is a perspective view of a light source device in accordance with a second embodiment of the present invention, the light source device having been mounted onto a conventional hat with a brim.
Figure 6:
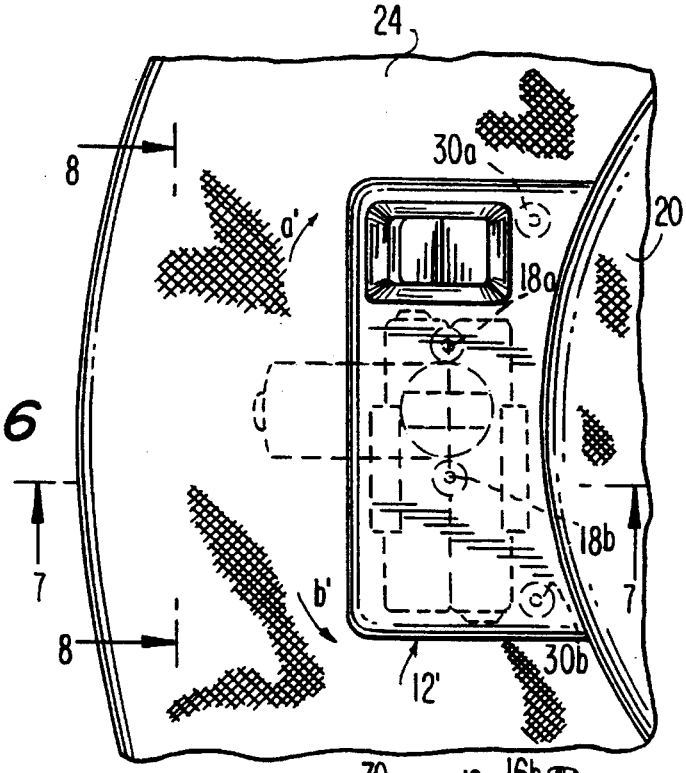
FIG. 6 is a top plan view of the light source device of FIG. 5.
Figure 7:
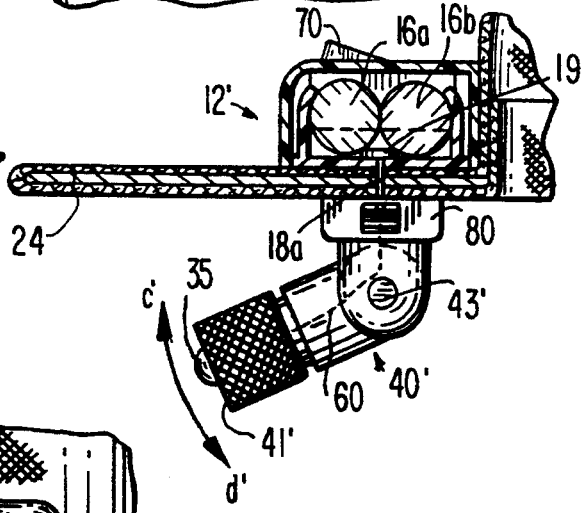
FIG. 7 is a cross-sectional view of the light source device taken along lines 7—7 of FIG. 6.
Figure 8:
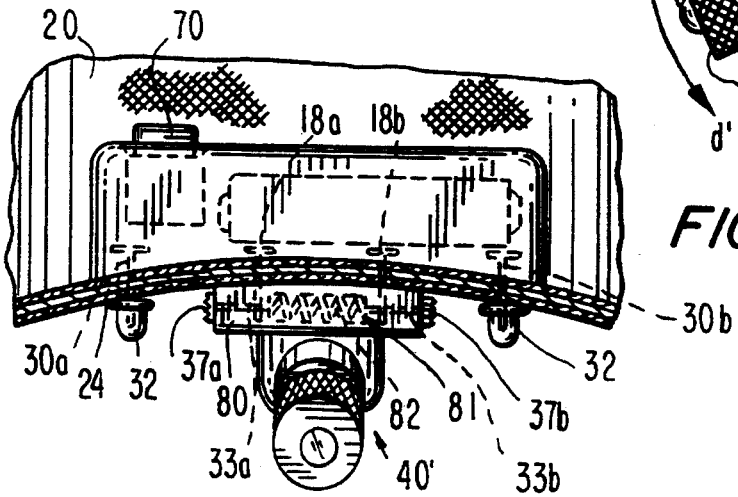
FIG. 8 is a is a cross-sectional view of the light source device taken along lines 8—8 of FIG. 6.

Reference is first made to FIG. 1 in which a perspective view of a clip light source device, generally indicated at 10, constructed in accordance with a first embodiment of the invention is provided and mounted on a brim 24 of a hat 20. Reference is also made to FIGS. 2–4 which more particularly describe clip light source device 10 (hereinafter "device 10"). Device 10 includes a clip, generally indicated at 50, having a first prong 50*a* and a second prong 50*b*. A battery housing, generally indicated at 12, is secured to first prong 50*a*. A light source housing, generally indicated at 40, is secured to second prong 50*b*. Light source housing 40 and battery housing 12 are preferably made of plastic, although metal may be used if one desires a more durable construction. Clip 50, preferably having generally a U or V-shape, is generally made of plastic or metal, and constructed so that first prong 50*a* and second prong 50*b* are biased towards each other to permit device 10 to be releasable and securely mounted on the front of brim 24 of hat 20 as shown in FIG. 1.

Light source housing 40 includes a light bulb socket 41 for receiving a light bulb 35. It is contemplated that light bulb 35 may have either a threaded end to screw into socket 41 or may include a clip-like or spring-like end which clips into socket 41 of light source housing 40.

Battery housing 12 is constructed to permit a plurality of batteries 16*a*, 16*b* to be inserted therein. Battery retainer clips 14*a*, 14*b* are provided to secure batteries 16*a*, 16*b* in battery housing 12. Battery housing 12 includes a cover 13 to cover and protect batteries 16*a* and 16*b*. Cover 13 is constructed to snap-on battery housing 12. Cover 13 may include a groove (not shown) to permit easy removal of cover 13 from the base of battery housing 12. Typically, a wedge device, such as a coin or screwdriver, may be inserted into the groove and rotated so as to "pop" cover 13 off the base of battery housing 12.

Battery housing 12 may include a battery contact 19 for providing electrical contact between batteries 16*a*, 16*b* and a wire 60. Wire 60 provides the electrical connection between battery contact 19 and light bulb socket 41. Light bulb socket 41 is also electrically connected to light bulb 35 when light bulb 35 is installed. Wire 60 is preferably embedded within clip 50, although wire 60 may also be adhered to an inner surface 50*c* of clip 50. A main concern is to ensure that no damage occurs to wire 60 during mounting and demounting of device 10 to brim 24 of hat 20 and therefore, the mounting of wire 60 within clip 50 best achieves this objective. Batteries 16*a*, 16*b* electrically contact battery contact 19, thereby providing electrical continuity between batteries 16*a*, 16*b* and light source housing 12 and light bulb 35.

Device 10 may also include a switch 70 which may be mounted on battery housing 12, for controlling whether light bulb 35 is "ON" or "OFF". In the preferred embodiment, switch 70 is an arcolectric switch, but it is contemplated that other switches, such as a push-button switch or the like, may be used to achieve the desired results. The electrical circuitry to connect switch 70 to battery housing 12 is known in the art.

Light source housing 40 is coupled to a pin (to be described in connection with FIG. 13), or the like, which in turn is mechanically coupled to prong 50*b* of clip 50 so as to permit light source housing 40 to both rotate at least 180° in the direction of arrow a and at least 180° in the direction of arrow b shown in FIGS. 2 and 4 in a plane substantially coplanar with brim 24. Similarly, light source housing 40 includes a pivot 43 so as to permit rotation of light source housing 40 in the direction of arrows c and d shown in FIG. 3. The high degree of rotation of light source housing 40 relative to clip 50 permits device 10 to be mounted along a continuum of brim 24, in addition to mounting device 10 on the front of brim 24, as further described below.

In a preferred embodiment, batteries 16*a*, 16*b* are AAA batteries which provide sufficient voltage and current to light light bulb 35. However, it is also contemplated that batteries 16*a*, 16*b* may be comprised of a single battery or a plurality of batteries comprising a different size, such as AA or a nine-volt battery, depending on the desired use of the invention and construction thereof. It is also contemplated that device 10 may be powered by a solar cell, solar battery or the like.

Reference is now made to FIGS. 5–8 in which a light source device, generally indicated at 10', constructed in accordance with a second embodiment of the present invention, is provided. Like reference numerals in FIGS. 5–8 are used to describe like components and structures used in the first embodiment of the invention and, accordingly, descriptions thereof will be omitted.

Light source device 10' (hereinafter "device 10'") is similar to device 10, although device 10' does not include a clip, but rather, a battery housing, generally indicated at 12', is mounted to brim 24 of hat 20 with the use of mounting screws or pins 30*a*, 30*b* and respective nuts 32. A light source housing, generally indicated at 40', is mounted to brim 24 so that brim 24 is disposed between light source housing 40' and battery housing 12'.

Specifically, battery housing 12' may be mounted and secured to brim 24 of hat 20 with a plurality of mounting screws or pins 30*a*, 30*b* which extend through brim 24. Pins 30*a*, 30*b* may extend through the bottom of battery housing 12' and further, extend through brim 24 a sufficient distance to receive nut 32, or the like so that housing 12' is anchored to brim 24 by nuts 32. Mounting pins 30*a*, 30*b* may be threaded to receive a threaded nut 32. Likewise, nut 32 may be a tension nut which releasable snaps to the end of pins 30*a*, 30*b*, respectively. Although a single mounting pin is contemplated hereby, in the preferred embodiment, it is desired that at least two mounting pins 30*a*, 30*b* are used so as to properly and symmetrically secure battery housing 12' to brim 24.

Connector pins 18*a*, 18*b* extend from battery housing 12' and through brim 24. In the preferred embodiment, a first end of each connector pin 18*a*, 18*b* is in electrical contact with batteries 16*a*, 16*b* through contact 19 while the second end of connector pins 18*a*, 18*b* extend through brim 24.

Light source housing 40' includes a neck portion 80. Contact holes are formed in neck portion 80. A spring assembly 81, disposed within light source housing 40', includes a spring 82 which biases a pair of contacts within a respective contact hole towards each other to in effect close each contact hole. A respective push rod 33*a*, 33*b* is disposed at either end of spring 82. A button 37*a*, 37*b* is mounted on each push rod 33*a*, 33*b* and extends from each side of light source housing 40'. When buttons 37*a*, 37*b* are pressed towards each other, spring 82 is compressed allowing the contacts in each contact hole to separate, opening each contact hole. Each contact is electrically coupled to a light socket 41' of light source housing 40' through wires 60. Connector pins 18*a*, 18*b* are releasable secured within neck portion 80 by spring assembly 81, located within neck portion 80. Spring assembly 81 provides a tension fit between connector pins 18*a*, 18*b* and the contacts under the influence of spring 82. Accordingly, when it is desired to mount light source housing 40' onto brim 24 so as to provide electrical contact between light source housing 40' and battery housing 12' and therefore, electrical contact between batteries 16*a*, 16*b* and light bulb 35, a user merely has to press buttons 37*a*, 37*b* towards each other, insert the ends of connector pins 18*a*, 18*b* which extend through brim 24 into the contact holes of neck 80 and release buttons 37*a*, 37*b* to provide a tension fit and complete the electrical circuit.

Similar to device 10, light source housing 40' may include a pin (not shown) to permit light source housing 40' to rotate 360° (180° in a direction a' (FIG. 6) or 180° in a direction b' (FIG. 6)) in a plane at least substantially parallel to brim 24 upon which device 10' is mounted. Similarly, device 10' includes a pivot 43' on light source housing 40' which permits the rotation of light source housing 40' in the directions of arrows c' or d' in FIG. 7.

Reference is now made to FIGS. 9–13 in which a clip light source device, generally indicated at 100, constructed in accordance with a third embodiment of the present invention, is provided on a conventional hat with a brim. Similar to the second embodiment, like reference numerals in FIGS. 9–13 are used to describe like components and structures used in the both the first and second embodiments of the invention and, accordingly, descriptions thereof will be omitted.

Clip light source device 100 (hereinafter "device 100") is similar to device 10, although device 100 has a construction that makes it more appropriate to mount device 100 on an edge of a garment, such as the edge of a hat, as specifically illustrated in FIG. 9. A clip, generally indicated at 150, includes prongs 150*a* and 150*b* that are shorter and wider than the corresponding prongs 50*a* and 50*b* of the first embodiment. In addition, a switch 170 can be conveniently mounted on a switch housing 171 which would be positioned, in the preferred mounting configuration, under the brim of the hat along with a light source housing, generally indicated at 140.

FIG. 11 illustrates a pin 110, located within light source housing 140. Pin 110 is the pin which permits light source housing 140 to rotate relative to a battery housing, generally indicated at 112, and similar to battery housing 12.

As can be seen in FIG. 13 in particular, the location of switch housing 171 does not interfere with the ability of light source housing 140 to rotate at least 180° in a direction of arrow e and at least 90° in a direction of arrow f as shown in FIG. 13. In all other respects, device 100 is very similar to device 10.

The operation of devices 10 and 100, constructed in accordance with the first and third embodiments, respectively, will now be described, clip device 10 being described by way of example.

In operation, a user may clip device 10 on the front of brim 24 of hat 20 at a desired location therealong. After turning switch 70 to the "ON" position so as to allow light bulb 35 to be turned on, the user manually directs the light on the desired area. Thereafter, if the user turns his head to look elsewhere, the light beam will always be directed on the area in which the user is looking.

Device 10 can also be mounted on the side of brim 24, similar to the capability of mounting device 100 on the front of brim 24. Because of the unique rotational ability of light housings 40 and 140 relative to clips 50 and 150, respectively, devices 10 and 100 can be mounted anywhere along the continuum of brim 24 and still permit the light beam from light bulb 35 to be directed in the line of sight of the user.

Devices 10 and 100 still yet have other uses which derive from its unique weight distributed construction and 360° rotating light source. Specifically, devices 10 and 100 can be mounted on the lapel of a jacket or clipped onto a shirt pocket, chest strap and even a tent flap, and by rotating light housing 40 or 140, respectively downward and away from the shirt, for example, the objective of having a light source directed on a particular work area is achieved. Likewise, device 10 or 100 could be mounted to a belt or any other article of clothing able to receive a clip. The ability of the light source to rotate in almost any direction allows the clip to be mounted in any plane and the mere rotation of the light source housing achieves the desired lighting effect.

In addition, device 10 or 100 can be stood on end, and will balance easily because of the equal weight distribution between the battery housing and the light source housing, or can be placed flat on a table. The versatility of the rotating light source permits the device to be positioned in almost any orientation while still permitting the light to illuminate the desired area.

By providing a light housing that is rotatable in any direction, an extremely versatile light source which can be used in a variety of applications is provided. By providing a construction that includes a clip and a rotatable light source housing, a light source that can be mounted on a variety of objects, such as a hat, and on the hat, in more than one location, a lapel of a shirt or jacket, a tent flap, a belt, or the like, to effect lighting of a desired area is provided. Similarly, by providing a device that includes a rotatable light source and has a more even weight distribution about a hat brim than the prior art, a light source that is more comfortable to wear is provided. Similarly, by constructing a light source that can rotate as disclosed herein and that has a more even weight distribution, a multipurpose light source that can be stood on an end thereof or placed on a table or the like to act as a flashlight to light a work area is provided. In addition, by distributing the weight and components both above and below the beam, a more aesthetic and sleeker looking hat and light source is provided. Similarly, a hat with a more natural feel than prior light/hat combinations is provided.

It will thus be seen that the objects set forth above, and those made apparent from the preceding description are efficiently obtained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall there between.

What is claimed is:

1. A clip light source device constructed to be mountable onto a hat having a brim, said device comprising:

a light source housing for housing a light source;

an energy source housing, electrically coupled to said light source housing, for housing an energy source for supplying energy to a light source in said light source housing; and a clip releasably securable to a brim of a hat, said clip including a first prong and a second prong, said light source housing secured to said first prong and said energy source housing secured to said second prong, whereby said brim is intermediate said light source housing and said energy source housing when said clip light source device is mounted on a brim of a hat.

2. The clip light source device as claimed in claim 1, wherein said light source housing can rotate 360° about a plane at least essentially parallel to a brim of a hat.

3. The clip light source device as claimed in claim 1, wherein said light source housing and said energy supply housing are made of plastic.

4. The clip light source device as claimed in claim 1, further including a switch to permit a light source to be in one of an "ON" or "OFF" state.

5. The clip light source device as claimed in claim 1, wherein said light source housing includes a socket for receiving a light bulb therein.

6. The clip light source device as claimed in claim 1, wherein said light source housing includes a pivot to permit said light source housing to pivot in a direction orthogonal to a plane formed by a brim of a hat.

7. A light source device constructed to be mountable onto a hat having a brim, said light source device comprising:

a light source housing for housing a light source;

an energy source housing, electrically coupleable to said light source housing, said energy source housing for housing an energy source for supplying energy to a light source in said light source housing; and means for releasably mounting said energy source housing and light source housing to a brim of a hat and means for electrically connecting said energy source housing to said light source housing to permit illumination of a light source, said brim being disposed between said light source housing and energy source housing.

8. The light source device as claimed in claim 7, wherein said light source housing can rotate 360° about a plane at least essentially parallel to a brim of a hat.

9. The light source device as claimed in claim 7, further including a switch to permit a light source to be in one of an "ON" or "OFF" state.

10. The light source device as claimed in claim 7, wherein said light source housing includes a pivot to permit said light source housing to pivot in a direction orthogonal to a plane formed by a brim of a hat.

11. The light source device as claimed in claim 7, further comprising a clip wherein said light source housing and energy source housing are mounted on the clip.

12. The light source device as claimed in claim 11, wherein said light source housing, said energy source housing and said clip are formed of a unitary construction.

13. The light source device as claimed in claim 7, further comprising mounting pins extending from said energy source housing to anchor said energy source housing to said brim.

14. The light source device as claimed in claim 7, further comprising connector pins extending from said energy source housing and being in electrical contact with said energy source housing and being received by said light source housing.

15. The light source device as claimed in claim 14, further comprising a spring assembly mounted within said light source housing for providing a tension fit with said connector pins.

16. A light source device constructed to be mountable onto a hat having a brim, said flashlight device comprising:

a light source housing for housing a light source;

an energy source housing, electrically coupled to said light source housing, said energy source housing for housing an energy source for supplying energy to a light source in said light source housing;

means for releasably connecting said energy source housing to a brim of a hat and means for electrically connecting said energy source housing to said light source housing to permit illumination of a light source; and means for permitting said light source housing to rotate 360° about a plane at least essentially parallel to a brim of a hat.

17. The light source device as claimed in claim 16, wherein said light source housing includes a pivot to permit said light source housing to pivot in a direction orthogonal to a plane formed by a brim of a hat.

18. The light source device as claimed in claim 16, further comprising a clip wherein said light source housing and energy source housing are mounted on the clip.

19. A light source device constructed to be mountable onto a hat having a brim, said light source device comprising:

a light source housing for housing a light source, said light source housing including a rotation means, disposed within said light source housing, for permitting said light source housing to rotate 360° about a plane at least essentially parallel to a brim of a hat about said rotation means;

an energy source housing, electrically coupleable to said light source housing, said energy source housing for housing an energy source for supplying energy to a light source in said light source housing; and means for mounting said energy source housing and light source housing to a brim of a hat and means for electrically connecting said energy source housing to said light source housing to permit illumination of a light source.

* * * * *